United States Patent [19]

Sevink

[11] 4,389,190

[45] Jun. 21, 1983

[54] SUPPORT OF SUSPENSION OF INSULATING MATERIAL

[76] Inventor: Theodor J. Sevink, Schaepmanstraat 54, 3762 SV Soest, Netherlands

[21] Appl. No.: 293,792

[22] Filed: Aug. 18, 1981

[51] Int. Cl.[3] ..... F27D 1/00

[52] U.S. Cl. ..... 432/247; 52/486; 52/506; 52/509; 110/332; 110/336; 432/252

[58] Field of Search ..... 432/247, 252; 110/332, 110/336, 339; 52/486, 487, 484, 506, 509, 513

[56] References Cited

U.S. PATENT DOCUMENTS

| | | | |
|---|---|---|---|
| 1,997,595 | 4/1935 | Nold et al. | 52/484 |
| 2,606,017 | 8/1952 | Longenecker | 432/252 |
| 3,400,672 | 9/1968 | Dickson | 52/484 |
| 4,246,852 | 1/1981 | Werych | 432/247 |

FOREIGN PATENT DOCUMENTS

| | | | |
|---|---|---|---|
| 984533 | 2/1965 | United Kingdom | 52/484 |

*Primary Examiner*—John J. Camby

*Attorney, Agent, or Firm*—Sughrue, Mion, Zinn, Macpeak and Seas

[57] ABSTRACT

When coating the inner surfaces of a furnace with strips of refractory mineral material or synthetic material such as felt, one often uses anchors which are welded to the shell of the furnace, which anchors are provided with recesses such that little plates can be secured to the anchor after having made a quarter of a revolution. These anchors represent energy loss and it is a time consuming job to weld all those anchors. This is eliminated by using metal strips with recesses which are punched out to at least one side. One can make now felt packages and some strips are provided with slots so that they can simply be attached to the furnace frame. If the side walls are coated by vertical packages, there also is no sag under the influence of their own weight.

5 Claims, 5 Drawing Figures

SUPPORT OF SUSPENSION OF INSULATING MATERIAL

Figure 1:
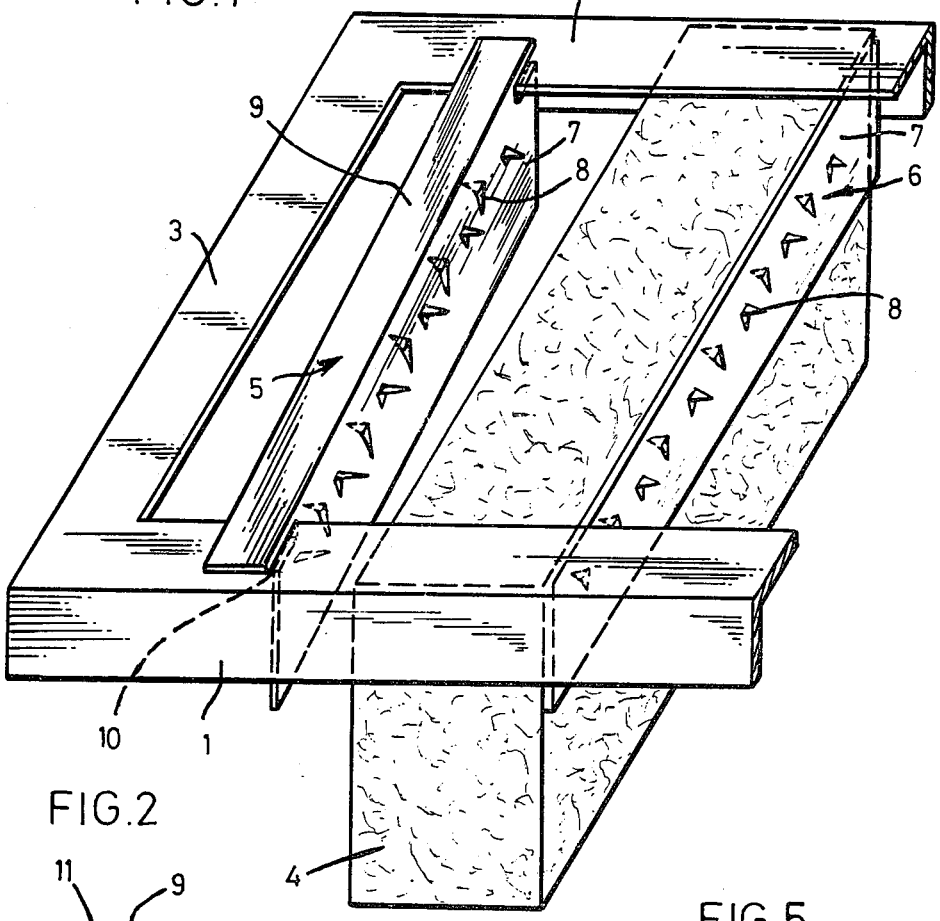

The present invention relates to a support or suspension for insulating material in a furnace, comprising a metal support frame of stainless material and strips of refractory mineral material or synthetic material which are connected to the support frame by the support or suspension.

Furnaces for all sorts of applications, like annealing and testing metals and burning ceramic products, were made of refractory stone, but the expertise which is necessary for the handwork to be performed becomes almost priceless, provided that it is available. Therefore there is a development going on during the last few years to compose said furnaces of other materials than refractory stones. Nowadays as insulating material refractory mineral or synthetic material is considered for use and therefore one speaks of felt furnaces at present.

A considerable problem when securing the refractory felts to particularly the ceilings of such furnaces has not been solved well yet. One often uses anchors, welded to the shell of the furnace, which anchors are provided with recesses such, that after having made a quater of a revolution, the little plates can be secured on the anchor at the correct location. This principle has the disadvantage that a large number of such anchors has to be provided which increases the cost price of the furnace, whereas moreover can be mentioned as disadvantage, that all said anchors with pertaining little plates will also incur much loss in energy because they can be considered to be so-called heat-bridges.

Tests have been carried out to determine whether the strips of refractory mineral or synthetic material might remain in their places by means of adhering them. This appears not to be so.

The invention tends to improve the above. It appears that this is achieved by still forming the support or suspension of metal, but having it positioned within the surface of the insulating material which is exposed to the heat.

The first embodiment of the invention is characterized in that the support consists of a metal strip which is formed by a plate with recesses, punched out to at least one side. Said recesses may be triangular, so that points are obtained, which protrude to at least one side.

A second possibility is characterized in that the support consists of a metal strip formed by a plate, at least one longitudinal edge of which is crenated or knurled.

When erecting such a furnace at least a plurality of the metal strips will have to consist of a metal plate with folded edge which is shorter than the plate, and the ends of the plate are provided with slots which are defined by the plate and the edge, so that the plate with folded edge can be shifted into the corner profiles of the support frame.

Furthermore the feature can be used that the folded edges of two plates are interconnected, for instance by spot welding.

In view of the fight against corrosion under the influence of the high temperature and moisture, it is preferred to form the metal strips and the support frame of stainless steel.

When all metal strips are formed as metal plate with folded edge, the exterior of the furnace is given a louvre-like appearance.

A furnace, which is provided with the above mentioned supports or suspensions, may be characterized in that the metal strips are arranged vertically along the upwardly directed walls.

This has the considerable advantage with respect to the horizontal arrangement, that lower felt layers will not longer sag under the influence of the weight of felt layers at a higher level.

Figure 2:
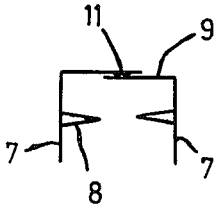

The invention will be eluciated hereinafter on the basis of the drawing, in which by way of example a plurality of embodiments is shown of a support or suspension according to the invention. In the drawing is illustrated by:

FIG. 1 in perspective a plan view of a metal support frame of a furnace having two embodiments of metal strips therein;

FIG. 2 a cross-section with two interconnected metal strips.

Figure 3:
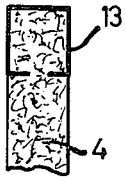
Figure 4:
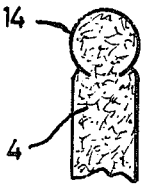

FIGS. 3 and 4 cross-sections of other embodiments of a metal strip, and

Figure 5:
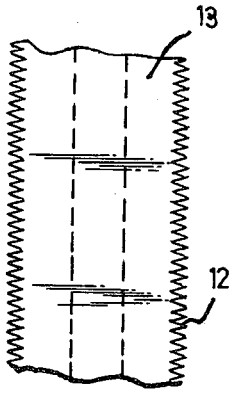

FIG. 5 a flattened view of a portion of the metal strip of FIG. 3.

In the drawing the support frame is symbolized by two parallel corner profiles 1 and 2 which are interconnected by a corner profile 3. The latter corner profile 3 is located anyway in or on the vicinity of the outer peripheral surface of the furnace, which is not further illustrated, but parallel to the corner profiles 1 and 2 more profiles may extend in the event of larger furnaces.

To said profiles 1 and 2 strips 4 of refractory mineral or synthetic material, like felt, have to be secured and this being done such that by the influence of the high temperatures, accompanied by a considerable moist development, they will not be unintentionally moved from their place, which appears to be a condition which is hard to meet, especially for ceilings of furnaces.

With the invention this is effectively achieved by metal strips 5 and 6, showing two possible embodiments of the invention, which are preferably made of stainless steel.

Both metal strips consist of a rectangular plate 7 with a length which is almost equal to the length of the strip 4 of refractory material, but with a considerably smaller height. The further these plates are away from the high temperature, the less they will function as heat bridge. The height only needs to be just sufficient to be able to punch protrusions 8 of sufficient strength therefrom.

In the illustrated embodiment said protrusions consist of triangular points, which are alternately punched to the one and to the other side of the central area of the plate 7, but they could also consist of rectangles which are punched from the area of the longitudinal edge thereof, so that a crenelled appearance is achieved.

If, as is usual for temperatures to be insulated up to the extent of 1000° C., various of the illustrated strips 4 are placed against each other then, as will be readily understood, a strong parcel of insulating strips is achieved on the intermediate plates 7, owing to the protrusions.

The connection with the metal support frame, which is particularly important for the insulation of a ceiling of a furnace, is achieved by providing at least a plurality of the plates 7 in the way, as indicated for metal strip 5, with a folded edge 9, which may be shorter than the metal strip, but should be adapted to rest on the profiles 1 and 2. In the plate 7 of the strip 5 a slot 10 is provided at both ends, so that the strip 5 is made slidable, as it were, over the profiles 1 and 2.

With the described and shown suspension it is possible to easily and quickly manufacture a well-fixed furnace lining. The further details, like the relation in which the strips 4 are placed along the walls and in the corners, as well as the special provision for the door and for the burner(s) or electric resistance elements may be left out of discussion here, but it is remarked, though, that the metal strips can now also be placed vertically along the upwardly directed side walls of the furnace so that the felt will not sag under the influence of its own weight.

In the variations as illustrated in FIG. 2 the folded edges 9 of two plates 7 are interconnected by spot welds 11, and the distance between the plates 7 corresponds with the thickness of a felt layer. It is striking that the triangular protrusions 8 are turned over 90° relative to FIG. 1.

As is illustrated in FIGS. 3–5 the two plates of FIG. 2 may also be made integrally and notches 12 may be provided which retain the felt strips 4. FIGS. 3 and 5 relate to a square-folded plate 13 and FIG. 4 relates to a circle-sector-like folded plate 14, the ends of which may of course be formed in the same way as shown in FIG. 1.

I claim:

1. An arrangement for mounting insulatory lining blanket strips within a high temperature furnace, comprising:

(a) a strip of insulatory furnace lining blanket formed of a refractory synthetic material such as felt, said strip having a generally solid rectangular shape, (b) a support frame including a pair of elongated stainless steel angle irons fixedly disposed parallel to each other and spaced apart a distance approximately equal to the length of said strip, (c) an elongated stainless steel anchor plate having projections thereon extending into said lining blanket strip across the length thereof and along an edge intended to face outwardly from the interior of the furnace, and (d) means defining slidable slot and rail connections between opposite ends of said anchor plate and said respective angle irons, whereby a plurality of lining blanket strips may be slidably mounted on said angle irons in stacked abutment to define an overall furnace lining.

2. An arrangement according to claim 1, wherein said anchor plate has a short folded edge to define an L-shape, said angle irons each have an inwardly extending rail, and a slot is provided in each end of said anchor plate to slidably accommodate an angle iron rail.

3. An arrangement according to claims 1 or 2, wherein said anchor plate projections are laterally extending triangular punch outs.

4. An arrangement according to claims 1 or 2, wherein said anchor plate is wrapped around said outwardly facing edge of said lining blanket strip, and said projections are toothed crenations along longitudinal edges of said plate.

5. An arrangement according to claim 2, wherein overlapping folded edges of two adjacent anchor plates are welded together.

* * * * *